United States Patent [19]

Baudis et al.

[11] 4,440,581

[45] Apr. 3, 1984

[54] PROCESS FOR THE PRODUCTION OF VANADIUM CARBIDE COATINGS ON IRON

[75] Inventors: Ulrich Baudis, Hanau; Peter Biberbach, Rodenbach; Wolfgang Weber, Karlstein, all of Fed. Rep. of Germany

[73] Assignee: Degussa Aktiengesellschaft, Frankfurt, Fed. Rep. of Germany

[21] Appl. No.: 278,617

[22] Filed: Jun. 29, 1981

[30] Foreign Application Priority Data

Jul. 2, 1980 [DE] Fed. Rep. of Germany ..... 3025033

[51] Int. Cl.[3] ..... C23C 9/10

[52] U.S. Cl. ..... 148/6.11

[58] Field of Search ..... 427/399, 431, 432; 148/6.11

[56] References Cited

U.S. PATENT DOCUMENTS

| | | | |
|---|---|---|---|
| 2,732,321 | 1/1956 | Gill et al. | 427/431 |
| 3,263,325 | 8/1966 | Jacobson | 427/432 |
| 3,671,297 | 6/1972 | Komatsu | 427/431 |
| 3,719,518 | 3/1973 | Komatsu et al. | 428/471 |

FOREIGN PATENT DOCUMENTS

| | | | |
|---|---|---|---|
| 2362284 | 12/1973 | Fed. Rep. of Germany | 427/435 |
| 39-12752 | 7/1964 | Japan | 148/611 |
| 54-147140 | 11/1979 | Japan | 427/341 |

*Primary Examiner*—Sam Silverberg

*Attorney, Agent, or Firm*—Cushman, Darby & Cushman

[57] ABSTRACT

Vanadium carbide layers are produced on iron and iron alloys having a content of at least 0.1 weight % carbon by treating the workpiece at 800° to 1100° C. in a salt bath which contains 1–30 weight % of vanadium or ferrovanadium powder. The salt bath consists of alkaline earth and/or alkali metal halide.

9 Claims, No Drawings

PROCESS FOR THE PRODUCTION OF VANADIUM CARBIDE COATINGS ON IRON

BACKGROUND OF THE INVENTION

The invention is directed to a process for the production of vanadium carbide layers (or coatings) on iron and iron alloys having a carbon content of at least 0.1 weight % by treating the workpiece of the iron or iron alloy at 800° to 1100° C. in a salt bath containing 1 to 30 weight % vanadium or ferrovanadium powder.

Vanadium carbide coatings are distinguished by a great hardness, resistance to wear and good resistance to oxidation and corrosion. Therefore there have been efforts to apply such coatings to workpieces made of iron and iron alloys, especially to tool parts and machine parts having high requirements, such as e.g., drawing tools, stamping tools, cutting tools, or nozzles.

There are already known numerous processes for the production of wear resistant vanadium carbide coatings. Thus German OS No. 2053063 describbes a process for forming a carbide coating of an element of the Va group of the periodic system of elements on the surface of metal objects. For this purpose, there is used a molten salt bath which contains boric acid or a borate and a metal powder of an element of the Va group. Hereby the metal forming the coating is partially dissolved in the very corrosive borate melt and in this manner is transported to the surface of the work material.

A modification of this process is described in German OS No. 2322159 in which case the metal forming the carbide layer is anodically dissolved in the melt.

In German OS No. 2322157 for the production of wear resistant carbide coatings the carbide forming metal is deposited cathodically on the workpiece from a borate melt.

Furthermore, there is described in German OS No. 2819856 a process in which the metal forming the coating is produced by reducing tthe corresponding metal oxide by means of a boron containing material such as ferroboron or boron carbide.

All of these known processes have a number of disadvantages. A common characteristic of the known processes is the use of boron oxide or borates as an essential constituent of the melts Borate or boron oxide containing melts, however, are extraordinarily corrosive at the high temperature of 800°–1100° C. necessary for the treatment. This frequently leads to noticeable attacks on the crucible material or on the work material being treated which sometimes is manifested in considerable surface roughness. Furthermore these melts even at high temperatures are extremely viscous. Because of the high viscosity of the boron containing melts, there can occur a nonuniform temperature distribution in the bath. To be sure the viscosity of these melts can be lowered somewhat by the addition of alkali halides but the viscosity producible thereby is still very high. Through this there is also carried out a considerable amount of the bath with the parts being treated whereby there occur high losses of salt. Furthermore, the melt adhering to the cooled parts is only removed with extraordinary difficulty because of its glass-like nature.

The known electrolytic process causes a larger expense for the process, such as e.g., exact bath controls and maintaining the current density constant and causes additional costs. In the process according to German OS No. 2819859, e.g. it is necessary to keep a very specific ratio of metal oxide to boron since with an excess of boron no carbide layer is formed but instead a boride layer. With a deficiency of boron likewise no carbide layer is formed since the reducing action is not sufficient.

Therefore it was the problem of the present invention to find a process for the production of vanadium carbide coatings on iron and iron alloys, e.g., steel, having a carbon content of at least 0.1 weight % by treatment of the workpiece at 800° to 1100° C. in a salt bath containing 1–30 weight % vanadium or ferrovanadium powder without the use of current and with a lower viscosity, little corrosive salt melt.

SUMMARY OF THE INVENTION

This problem was solved according to the invention by having the salt bath consist of alkaline earth and/or alkali metal halides. Surprisingly it has been found that even without the use of boron or boron oxide containing melts vanadium carbide coatings of the most excellent quality are obtained if molten alkaline earth metal and/or alkali metal halides, especially in the form of their chlorides and/or fluorides are employed for the activation of the solid vanadizing agent (ferrovanadium or vanadium powder). The activating effect consists of making possible a direct solid reaction between the vanadizing agent and the surface of the work material being coated. The vanadium coming in contact with the work material surface reacts with the carbon of the substrate material with formation of a bound, uniform, tightly adhering vanadium carbide layer or coating.

Illustrative of the alkali metal and alkaline earth metal halides are sodium chloride, sodium fluoride, sodium iodide, sodium bromide, potassium chloride, potassium bromide, potassium fluoride, potassium iodide,, barium bromide, barium chloride, barium iodide, calcium chloride, calcium iodide, magnesium chloride, and strontium chloride.

Preferably there is used as the salt melt barium chloride to which there can advantageously be added 1–50 weight % of sodium chloride. For the production of uniform vanadium supply it has proven advantageous to use as finely divided ferravanadium powder as possible and to distribute this as homogeneously as possible in the melt. This can be attained, e.g. in a mechanical manner through an efficient stirrer. However, it is particularly advantageous for the distribution to lead an inert gas stream, e.g. nitrogen or argon, through the melt. By using a ring nozzle which is provided with specially arranged gas outlet openings according to the size of the crucible and the amount of the melt there is produced a very uniform distribution of the vanadizing agent.

This preferred procedure has the further advantage that there is formed a protective gas curtain on the surface of the bath which reduces the access of oxygen from the air to the oxidation sensitive vanadizing agent. Through this the life of the bath is increased considerably.

The melt of the invention compared to the known baths shows a number of advantages. Even at low treatment temperatures it is thinly liquid, through which the losses of salt by entrainment are small. The adhering salt residues can be easily removed by washing. Since attacks of corrosion do not occur because of the neutral behavior of the salt there can be used to receive the melts crucibles made of relatively cheap mild steel.

There can be produced in practice according to the process of the invention within 2–4 hours depending on the temperature and the carbon content of the base material layer thicknesses of 2–16μ.

The following examples explain the process of the invention in greater detail.

Unless otherwise indicated all parts and percentages are by weight.

The process can comprise, consist essentially of or consist of the steps recited with the stated materials.

DETAILED DESCRIPTION

EXAMPLE 1

There were melted and heated to a temperature of 950° C. in a mild steel crucible having a diameter of 18 cm and a depth of 30 cm a mixture of 19 kg of barium chloride, 1 kg of sodium chloride and 1 kg of ferrovanadium having a particle size less than 150μ. The ferrovanadium powder was homogeneously distributed in the melt with the help of a stirrer. A workpiece of steel Ck 60 was treated in this bath for 4 hours and cooled in the air. The metallographic investigation showed that there was formed an about 10μ thick, homogeneous and smooth layer on the surface. This can be identified by X-ray as vanadium carbide (VC).

EXAMPLE 2

In a manner similar to Example 1 there were melted 20 kg of $BaCl_2$ and it was treated with 3 kg of ferrovanadium powder. The temperature was adjusted to 1050° C. In treating a sample of X155 CrVMo12 in this melt after 2 hours there was obtained on the surface an about 8μ thick, uniform and homogeneous vanadium carbide coating.

EXAMPLE 3

There were melted and heated to a temperature of 930° C. in a mild steel crucible having a diameter of 18 cm and a depth of 30 cm a mixture of 18 kg of $BaCl_2$, 2 kg of NaCl and 1.5 kg of ferrovanadium having a particle size below 50μ. There was led through the melt a stream of nitrogen at a rate of 80 liters/hour. A sample of Ck 60 treated therein for 3 hours showed a vanadium carbide layer having a thickness of 6μ.

EXAMPLE 4

In the manner set forth in Example 3 a mixture of 10 kg $BaCl_2$, 5 kg KF, 3.6 kg NaF and 2.4 kg ferrovanadium powder were melted and heated to 850° C. A stream of argon was led through the melt at a rate of 60 liters/h. After 6 hours treatment samples of 100 Cr 6 showed vanadium carbide layers having a thickness of 4–5μ.

EXAMPLE 5

In a procedure analogeous to Example 3 except that in place of ferrovanadium there was used pure vanadium powder and there was produced on steel 34 CrMo4 after 4 hours treatment a vanadium carbide layer having a thickness of 4μ, on steel C45 there was produced a vanadium carbide layer having a thickness of 6μ.

The layers produced are always compact, homogeneous and smooth. They show a high hardness (about 3000 HV) and an extraordinarily good resistance to abrasion.

Pure alkali metal halides are likewise usable for the process of the invention but the baths are very thinly liquid and volatilize at high temperatures so that insertion is only possible at relatively low temperatures.

The entire disclosure of German priority application No. P3025033.0 is hereby incorporated by reference.

What is claimed is:

1. A process for the production of a vanadium carbide layer on iron or an iron alloy having a carbon content of at least 0.1 weight% by a solid state reaction comprising treating a workpiece of the iron or iron alloy at a temperature of 800° to 1100° C. in a salt bath which contains 1–30 weight % of vanadium or ferrovandium powder, said salt bath consisting essentially of 50 to 100% barium chloride and a member selected from the group consisting of an alkaline earth metal halide, another alkali metal halide or a mixture of both an alkali metal halide and another alkaline earth metal halide.

2. A process according to claim 1 wherein as the halide there is employed a chloride, a fluoride, or a mixture of chloride and fluoride.

3. A process according to claim 2 wherein the salt bath consists of 50–100% barium chloride and a member selected from said another alkaline earth metal halide, alkali metal halide, or mixture of alkali metal halide and another alkaline earth metal halide.

4. A process according to claim 3 wherein the salt bath contains 1–50 weight % sodium chloride.

5. A process according to claim 2 wherein the salt bath contains 1–50 weight % of sodium chloride.

6. A process according to claim 4 wherein the vanadium or ferrovandium powder is homogeneously, distributed in the salt melt.

7. A process according to claim 1 wherein the vanadium or ferrovanadium powder is homogeneously distributed in the salt melt.

8. A process according to claim 1 wherein an inert gas stream is led into the salt melt.

9. A process according to claim 4 wherein an inert gas stream is led into the salt melt.

* * * * *